US010145352B2

(12) United States Patent
Tang

(10) Patent No.: US 10,145,352 B2
(45) Date of Patent: Dec. 4, 2018

(54) RESONANT IGNITION CIRCUIT

(71) Applicant: FAIRCHILD SEMICONCTOR CORPORATION, Sunnyvale, CA (US)

(72) Inventor: Qingquan Tang, Breinigsville, PA (US)

(73) Assignee: Fairchild Semiconductor Corporation, Phoenix, AZ (US)

( * ) Notice: Subject to any disclaimer, the term of this patent is extended or adjusted under 35 U.S.C. 154(b) by 0 days.

(21) Appl. No.: 15/674,221

(22) Filed: Aug. 10, 2017

(65) Prior Publication Data

US 2018/0066626 A1 Mar. 8, 2018

Related U.S. Application Data

(60) Provisional application No. 62/383,069, filed on Sep. 2, 2016.

(51) Int. Cl.
*F02P 9/00* (2006.01)

(52) U.S. Cl.
CPC ..... *F02P 9/002* (2013.01)

(58) Field of Classification Search
CPC ..... F02P 9/00; F02P 9/002; F02P 17/12
See application file for complete search history.

(56) References Cited

U.S. PATENT DOCUMENTS 5,801,534 A * 9/1998 Hohner ..... F02P 17/12 123/644

OTHER PUBLICATIONS

Fairchild Semiconductor Corporation, is now part of On Semiconductor, "AN-8208 Introduction to Automotive Ignition Systems," Apr. 28, 2014.

* cited by examiner

*Primary Examiner* — Hieu T Vo
(74) *Attorney, Agent, or Firm* — Brake Hughes Bellerman LLP

(57) ABSTRACT

In a general aspect, an ignition circuit can include a control circuit configured to receive a command signal from an engine control unit, and a driving circuit coupled with the control circuit. The driving circuit can be configured to be coupled with a resonant circuit that includes a primary winding of an ignition coil. The control circuit and the driving circuit can be configured, in response to a command signal, to drive the resonant circuit at a first frequency to generate a voltage in the ignition coil to initiate a spark in a spark plug; and, in response to the spark being initiated in the spark plug, drive the resonant circuit at a second frequency to maintain the spark in the spark plug for combustion of a fuel mixture. The control circuit can be configured to, after the combustion of the fuel mixture, to disable the driving circuit.

20 Claims, 13 Drawing Sheets

RESONANT IGNITION CIRCUIT

CROSS-REFERENCE TO RELATED APPLICATION

This application claims priority to and the benefit of U.S. Provisional Application No. 62/383,069, filed Sep. 2, 2016, entitled "RESONANT IGNITION CIRCUIT", which is hereby incorporated by reference in its entirety.

TECHNICAL FIELD

This description relates to ignition circuits, such as for use in ignition systems in automotive applications (e.g., internal combustion engines).

BACKGROUND

In current ignition systems, such as those implemented in internal combustion engines, an amount of energy that can be delivered to a spark plug to ignite and combust air fuel mixture in an engine cylinder is limited by size and/or cost of a corresponding coil (ignition coil, transformer, etc.). Accordingly, a primary winding of the coil must be sized such that it can store sufficient energy for facilitating both ignition (e.g., spark initiation) and combustion (burning) of the air fuel mixture in an associated cylinder of the engine. For a conventional coil, a large number of primary winding turns are used in order to provide sufficient inductance to store energy for each ignition cycle. Further, in order to achieve a turns ratio that reduces voltage stress on the primary winding, a large number of secondary winding turns can also be used. As a result, a resistance of the secondary winding of such a coil can be in the range of 4-10 kilo-ohm £kohm), which can limit the amount of energy that is delivered to a corresponding spark plug during a spark/ignition cycle (e.g., to ignite and combust fuel and air mixture). Furthermore, energy that is dissipated by a leakage inductance of the coil through a high voltage switch used to control charging of the primary winding of the coil (e.g., an insulated-gate bipolar transistor (IGBT) device), can put electrical stress on the switch (e.g., IGBT device) and also reduce electrical efficiency of the ignition system (circuit).

As an example, current ignition systems (circuits) can include, for each cylinder of an associated engine, an ignition coil, an ignition IGBT device, a control circuit and a spark plug. Such systems can also include an engine control unit (ECU) that communicates with the circuit components for each cylinder to indicate when each cylinder should perform a spark event (ignition event, combustion event, etc.). For example, for a given cylinder, the ECU can provide a command signal (e.g., a logic high level) that causes the control circuit to generate a turn-on voltage for the ignition IGBT. Turning on the ignition IGBT causes current to flow through the primary winding of the ignition coil to store energy for the spark event, where current through the primary winding of the ignition coil increases based on the coil's primary impedance (e.g., inductance and/or resistance).

In such circuits, the coil's secondary side is an open circuit before arcing of the spark plug (e.g., due to the high impedance of the spark plug gap), thus energy (all energy, substantially all energy) for the spark event (ignition and combustion) is temporarily stored in the magnetic core of the coil. To fire the spark plug, the command signal from the ECU can, for this example, change to a logic low level, which results in the ignition IGBT being turned off. This rapid change of current in the primary winding of the coil induces a high voltage spike across the ignition IGBT as the coil's leakage inductance is discharged, and a high voltage is generated across the coil's secondary winding, which ignites (fires) the spark plug and combusts the fuel and air mixture in the cylinder. This sequence of events, which is repeatedly performed during operation of an associated engine, results in significant electrical stress on the components of the ignition circuit.

In a general aspect, an ignition circuit can include a control circuit that is configured to be coupled with an engine control unit (ECU) to receive a command signal from the ECU, and a driving circuit coupled with the control circuit, the driving circuit being configured to be coupled with a resonant circuit that includes a primary winding of an ignition coil. The control circuit and the driving circuit can be configured, in response to a command signal, to drive the resonant circuit at a first frequency to generate a voltage in the ignition coil to initiate a spark in a spark plug coupled with the ignition coil; and, in response to the spark being initiated in the spark plug, drive the resonant circuit at a second frequency to maintain the spark in the spark plug for combustion of a fuel mixture. The control circuit can be further configured to, after the combustion of the fuel mixture, to disable the driving circuit.

DETAILED DESCRIPTION

Implementations of ignition circuits described herein provide more energy to a spark plug during an ignition event, and to provide that energy more efficiently than current implementations by providing energy for ignition events in two-stages by using a resonant circuit, e.g., an inductive-capacitive (LC) resonant circuit, such as those described herein. In a first stage, the ignition circuits described herein operate in a high-voltage accumulation mode to generate a sufficiently high voltage for initiating spark across a spark gap of an associated spark plug (e.g., 15-40 kV depending on the particular implementation).

After initiating a spark across the spark plug, the circuit can operate in a second, power delivery, mode to deliver power to the spark plug to facilitate combustion (burning) of a fuel and air mixture in an associated cylinder of an engine (e.g., to maintain the spark in the spark plug after it is initiated). Such implementations are capable of efficiently delivering the energy needed to arc the spark plug (e.g., high voltage generation mode) and to burn the fuel mix (energy or power delivery mode) using soft-switching (e.g., with very low switching loss due to operation of the resonant circuit). This can be accomplished, at least in part, by utilizing a leakage inductance of a high-frequency (HF) ignition coil, which can have a lower number of turns (primary and secondary turns) and also have a lower turns ratio than current ignition circuit implementations. However, in some implementations, the HF ignition coil turns ratio can be higher than a conventional ignition coil, though the overall number of turns in each winding are comparatively reduced (resulting in lower coil impedances). For instance, a HF ignition coil used in the disclosed implementations can have a turns ratio of secondary winding turns to primary winding turns in a range of 50:1 to 200:1.

Implementations of ignition systems (circuits) described herein can include a multi-resonant circuit that allows for implementation of the two modes discussed above. The multi-resonant circuit can include a drive circuit and a charging/discharging circuit (charging circuit). The charging circuit can include a leakage inductance of the HF ignition coil (coil) and/or a magnetizing inductance of the coil (resonant inductance), where the resonant inductance is resonant with an in-series (or in parallel) resonant capacitor. A half-bridge (or full-bridge) circuit can be used to drive the resonant charging circuit (where the half-bridge or full-bridge circuit can be referred to as a driving circuit). In such implementations, the half-bridge or full-bridge circuit can include low on-resistance (Rdson), fast metal-oxide-semiconductor field-effect transistors (MOSFETs) to achieve high switching frequencies, and can efficiently provide power for ignition events using the techniques described herein.

Figure 1:
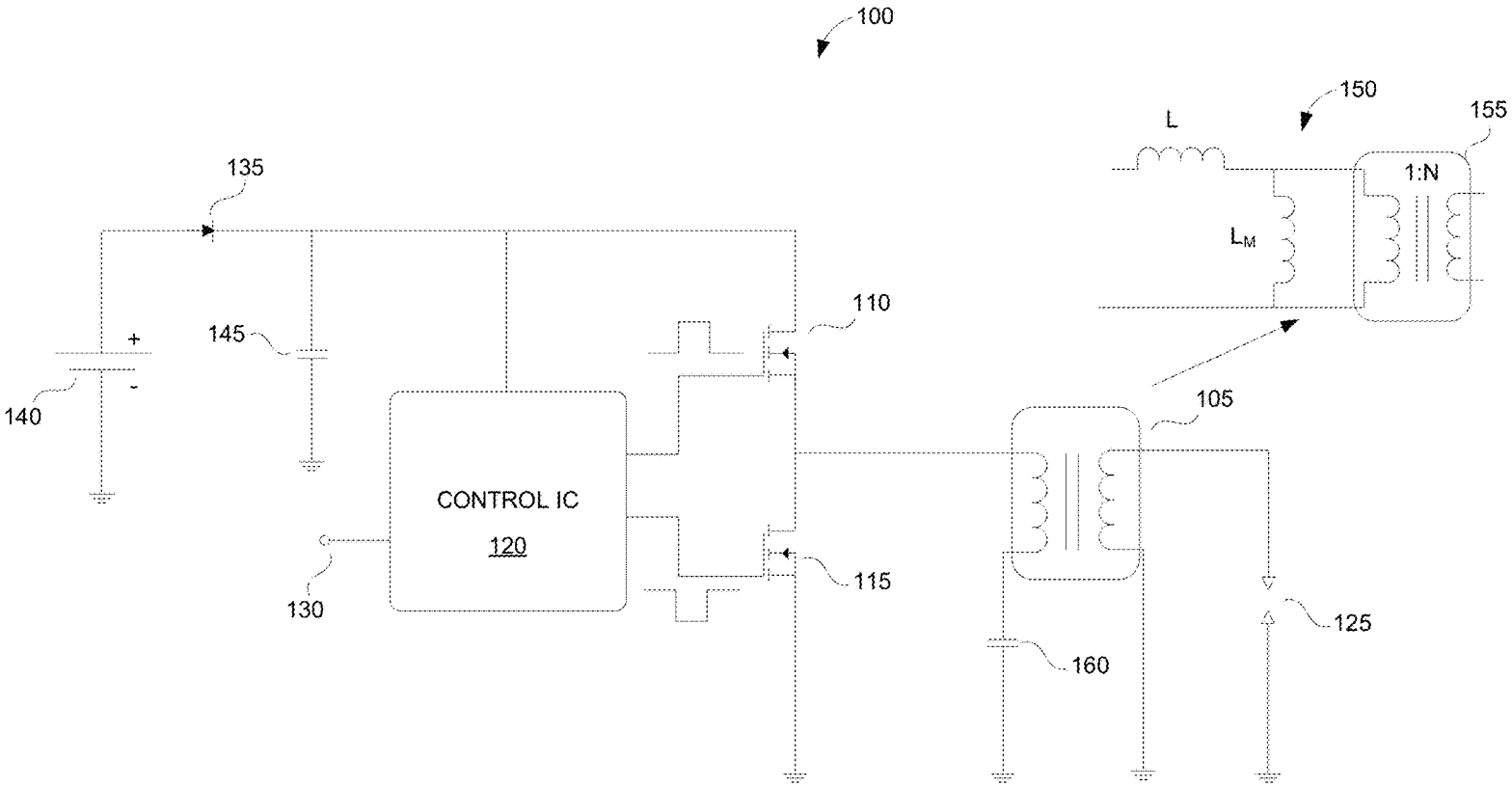
FIG. 1 is a schematic/block diagram of an ignition circuit, according to an implementation.

FIG. 1 is a schematic/block diagram that illustrates an example implementation of a multi-resonant ignition circuit (circuit) 100. The circuit 100 of FIG. 1 includes a HF ignition coil (HF coil, coil, ignition coil) 105 (such as discussed above), two MOSFETs 110 and 115 forming a half-bridge circuit, a control IC (drive circuit) 120, a spark plug 125, and an input terminal 130 to receive a control (command) signal from an ECU (not shown). The circuit 100 of FIG. 1 also includes a blocking diode 135 to prevent damage to the components of the ignition circuit 100 under reverse battery conditions. In other implementations, a MOSFET device could be used in place of the blocking diode 135. The circuit 100 of FIG. 1 also includes a supply capacitor 145 that stabilizes (e.g., reduces variation/noise) on a battery voltage supply line that supplies power to the ignition circuit 100.

As discussed above, the control circuit (control IC) 120 can be configured to drive the charging circuit at two different switching frequencies, a first frequency for implementing the high voltage generation mode to generate a spark initiation voltage, and a second frequency for implementing the power delivery mode to deliver power for combustion of fuel mixture in an associated engine cylinder. Depending on the particular implementation, the second frequency can be greater than or less than the first frequency. Further, the specific first and second frequencies for a given ignition circuit will depend on the specific implementation. While, the examples given herein are in the range of tens of kilohertz (kHz) to hundreds of kHz, in other implementations, other frequencies can be used. Also, while in the examples given herein, the second frequency is greater than the first frequency, in other implementations, the first frequency can be greater than the second frequency.

As shown in FIG. 1, the HF ignition coil 105 can be represented (e.g., for the purposes of the simulations described herein) as a modeled inductor 150 that includes a leakage inductance (L), a magnetic inductance ($L_M$) and an ideal transformer 155 with a turns ratio of 1:N. In such implementations, the first frequency, at which the control IC 120 drives the half-bridge circuit (e.g. including the MOSFETs 110 and 115) for the high voltage generation mode (e.g., spark initiation), can be determined (established, set, etc.) based on the resonant frequency of the combination of a resonant capacitor 160, the leakage inductance L, the magnetic inductance $L_M$, and a parasitic capacitance of the spark plug 120. The second frequency, at which the control IC 120 drives the half-bridge circuit for the power delivery mode (e.g., combustion), can be determined based on a desired amount of power to be delivered to the spark plug during combustion, or could be preset at a resonant frequency that is determined by a resonant frequency of the resonant capacitor 160, the leakage inductance L, the magnetic inductance $L_M$, and an impedance of spark gap during combustion (e.g., after arcing or spark initiation has occurred).

Figure 5:
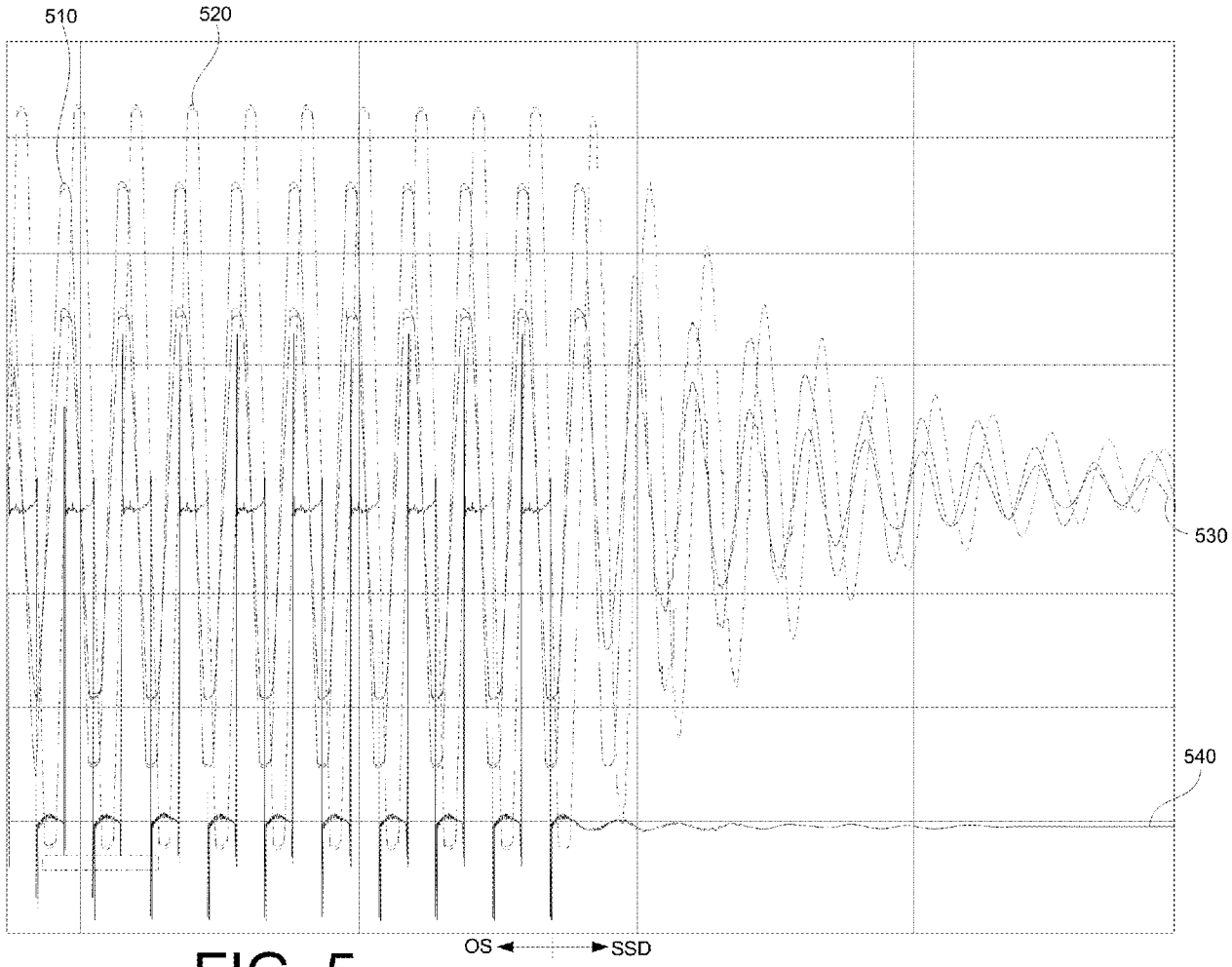
FIG. 5 is a timing diagram illustrating circuit simulation results showing shut down behavior for an implementation of the circuit of FIG. 1.

The circuit 100 of FIG. 1 also operates with a soft shutdown feature. That is, once complementary switching of the MOSFETs 110 and 115 of the half-bridge circuit stops, current and voltage in the charging circuit can smoothly shut down (e.g. decay toward zero), such as illustrated in FIG. 5. As a result there is no large turn off spike in the ignition coil 105, which reduces electrical stress on the components of the ignition circuit (as compared with current implementations) and allows for elimination of high voltage clamping circuits used in current ignition circuits.

Figure 2A:
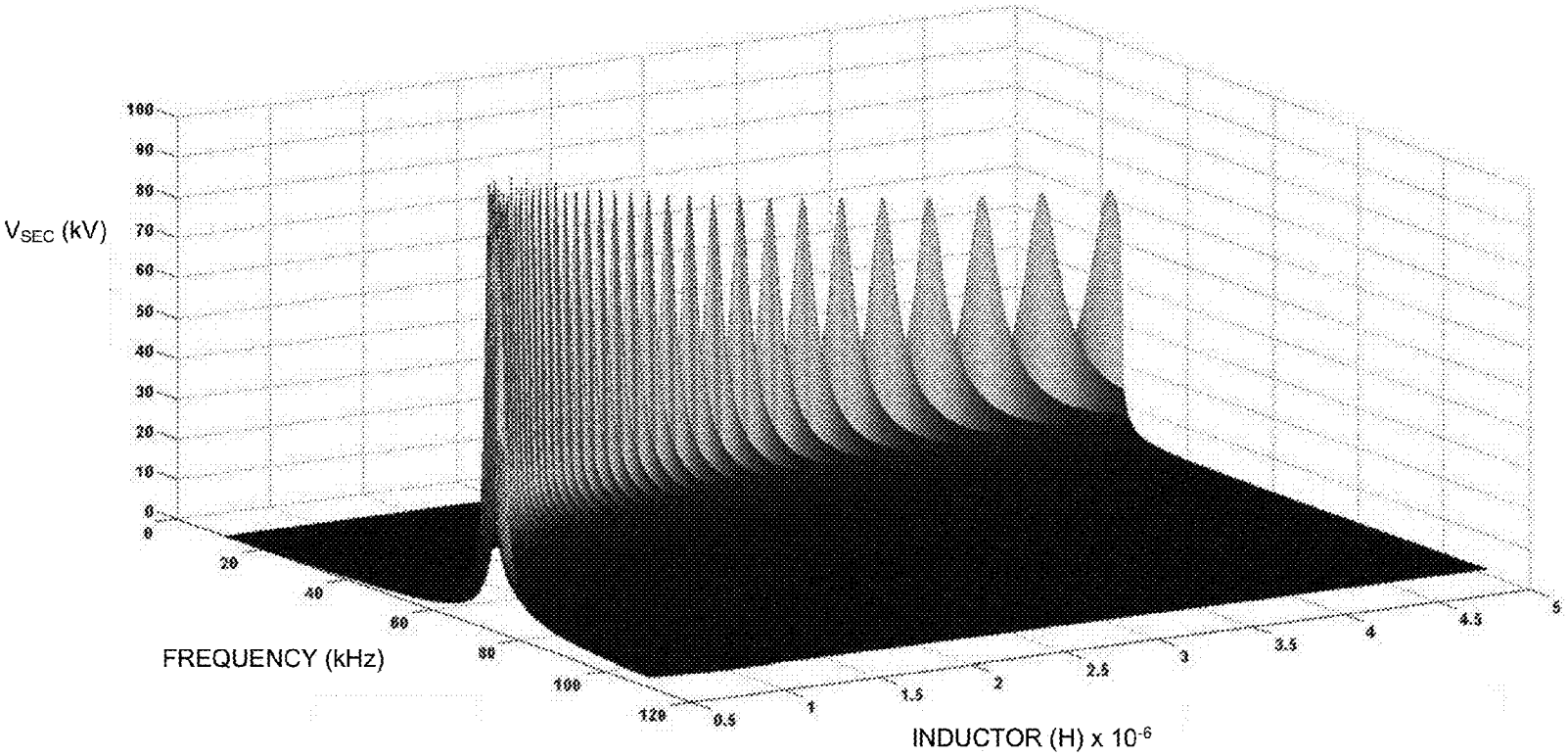
FIGS. 2A-2C are graphs illustrating circuit simulation results for an implementation of the circuit of FIG. 1 in a first mode of operation.
Figure 2B:
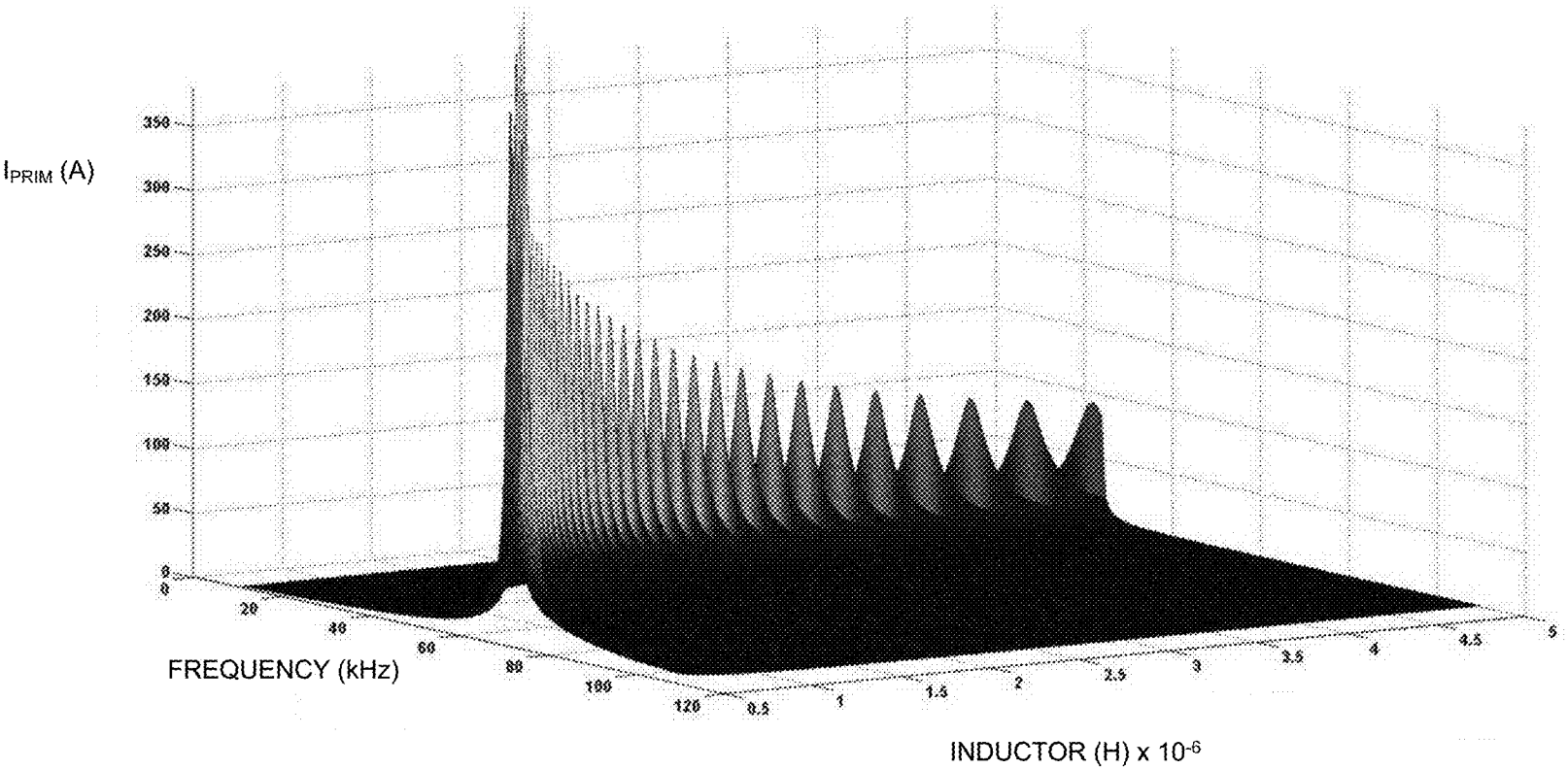
Figure 2C:
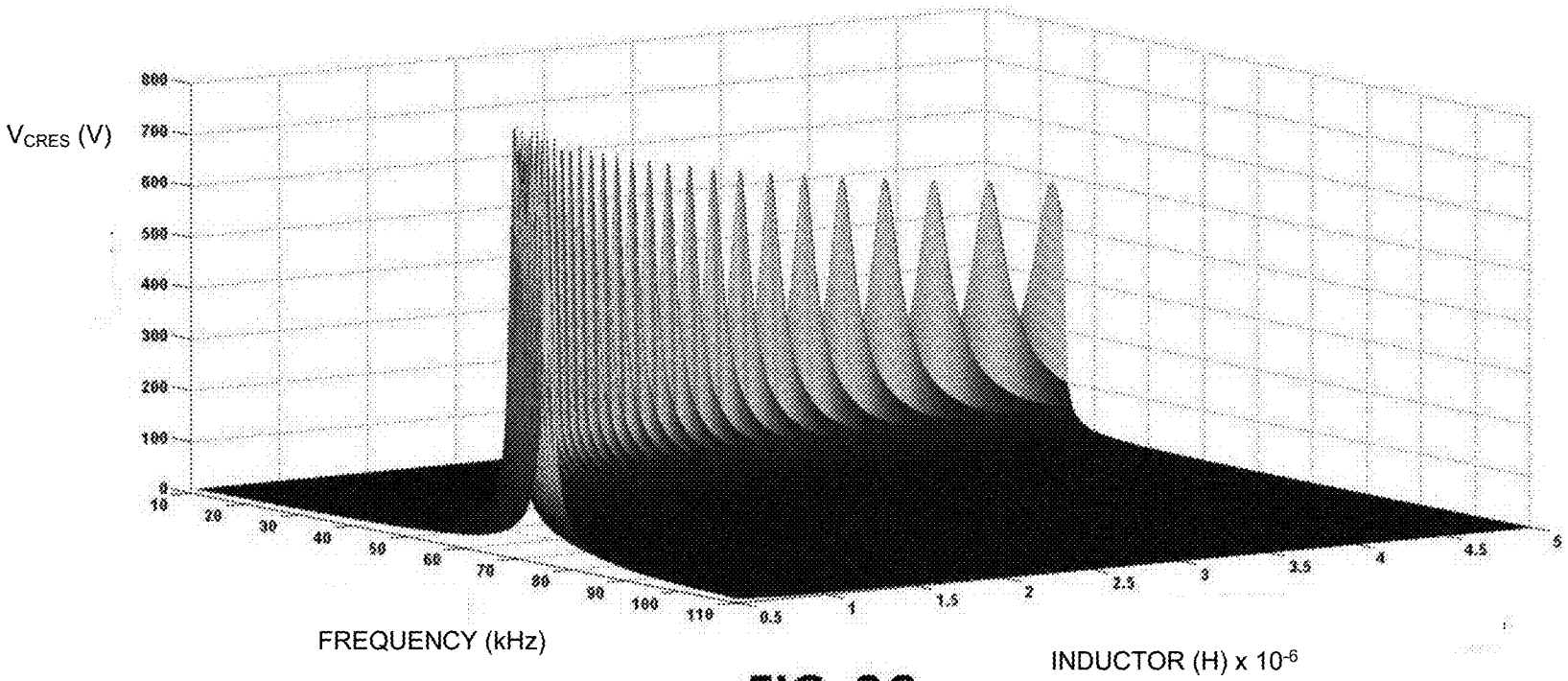

FIGS. 2A-2C are 3-dimensional (3D) graphs illustrating simulation results of an implementation of the circuit 100 in FIG. 1. The simulation results of FIGS. 2A-2C show operation of the simulated circuit 100 in high-voltage accumulation mode (which can also be referred to as high-voltage generation mode) before arcing in a spark plug (e.g., with the spark gap being simulated as a high impedance air gap across the simulated ranges in FIGS. 2A-2C). The simulation results of FIGS. 2A-2C (as well as the simulation results of FIG. 3A-5) are shown for purposes of illustrating voltage and energy generation capabilities of the circuit 100 of FIG. 1. It is noted that, in the 3D graphs of FIGS. 2A-2C, the notches (spaces between illustrated peaks) are due to (are artifact of) a limited number of simulation steps used to generate the simulation graphs and, accordingly, do not illustrate gaps in voltages and currents produced in the circuit 100.

In the simulation results of FIGS. 2A-2C, the circuit of FIG. 1 is simulated with a battery voltage of 14 V, a ratio of magnetic inductance current to leakage inductance current of 3:1, a capacitance of the resonant capacitor 160 of 1.27 microfarad (μF), a turns ratio in the ideal transformer coil of 150:1 and a resistance of the primary winding of the coil 105 of 10 milliohms (mohm). In the simulation of FIGS. 2A-2C, the spark gap (load) of the spark plug 125 is simulated as a 20 pF capacitor in parallel with a 5 mega-ohm (Mohm) resistor (i.e., to simulate the spark plug 125 before arcing has occurred and a spark has been initiated in the spark plug 125).

The simulation results of FIGS. 2A-2C are shown across a range of $L_M$ values and a range of frequencies used to drive the half-bridge circuit (e.g., gate terminals of the MOSFETs 110 and 115), with FIG. 2A showing resulting voltages across the secondary winding of the HF ignition coil, FIG. 2B showing resulting currents through a primary winding of the HF coil 105 and FIG. 2C showing resulting voltages across the resonant capacitor 160.

As shown in FIG. 2A, the circuit 100 is capable of generating over 70 kV across the secondary winding of the HF coil 105 and the voltage across the secondary winding ($V_{sec}$) drops slowly with higher coil inductance. FIG. 2B illustrates reduction in current in the primary winding ($I_{prim}$) of the HF coil 105 with higher inductor values. There is, however, a tradeoff between coil inductance and current. Specifically, at higher coil inductance, current may be reduced, which could require a larger coil size to achieve desired performance.

FIG. 2C illustrates voltage across the resonant capacitor 160 ($V_{Cres}$). The peaks in the simulation results of FIGS. 2A and 2C illustrate the voltages that are achievable at a given resonant frequency and inductor value combination. As noted above, notches (spaces between illustrated peaks) in FIGS. 2A-2C are due to the limited number of simulation steps used to generate the simulation graphs and, accordingly, do not illustrate gaps in voltages and currents produced in the circuit 100.

Figure 3A:
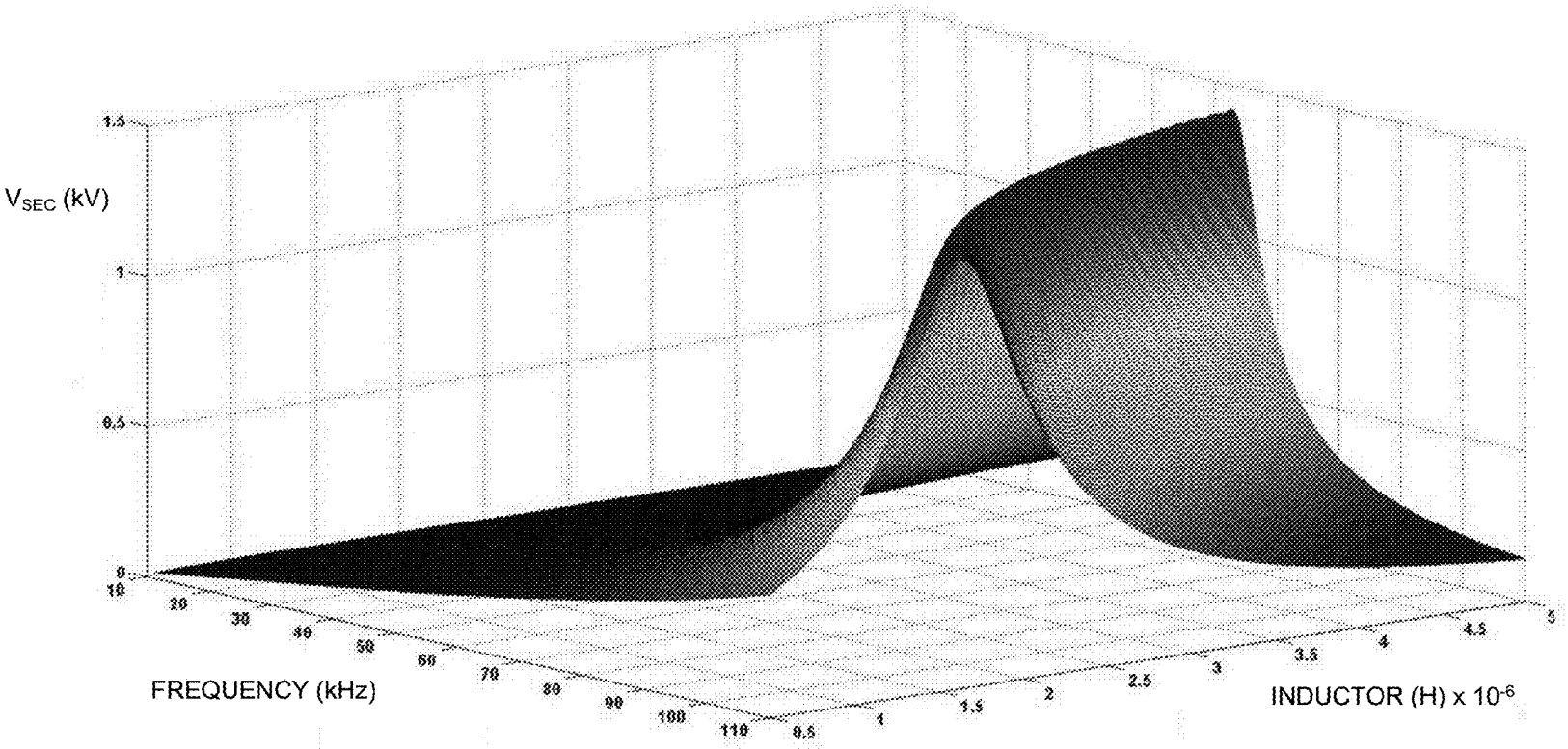
FIGS. 3A-3C are graphs illustrating circuit simulation results for an implementation of the circuit of FIG. 1 in a second mode of operation.
Figure 3B:
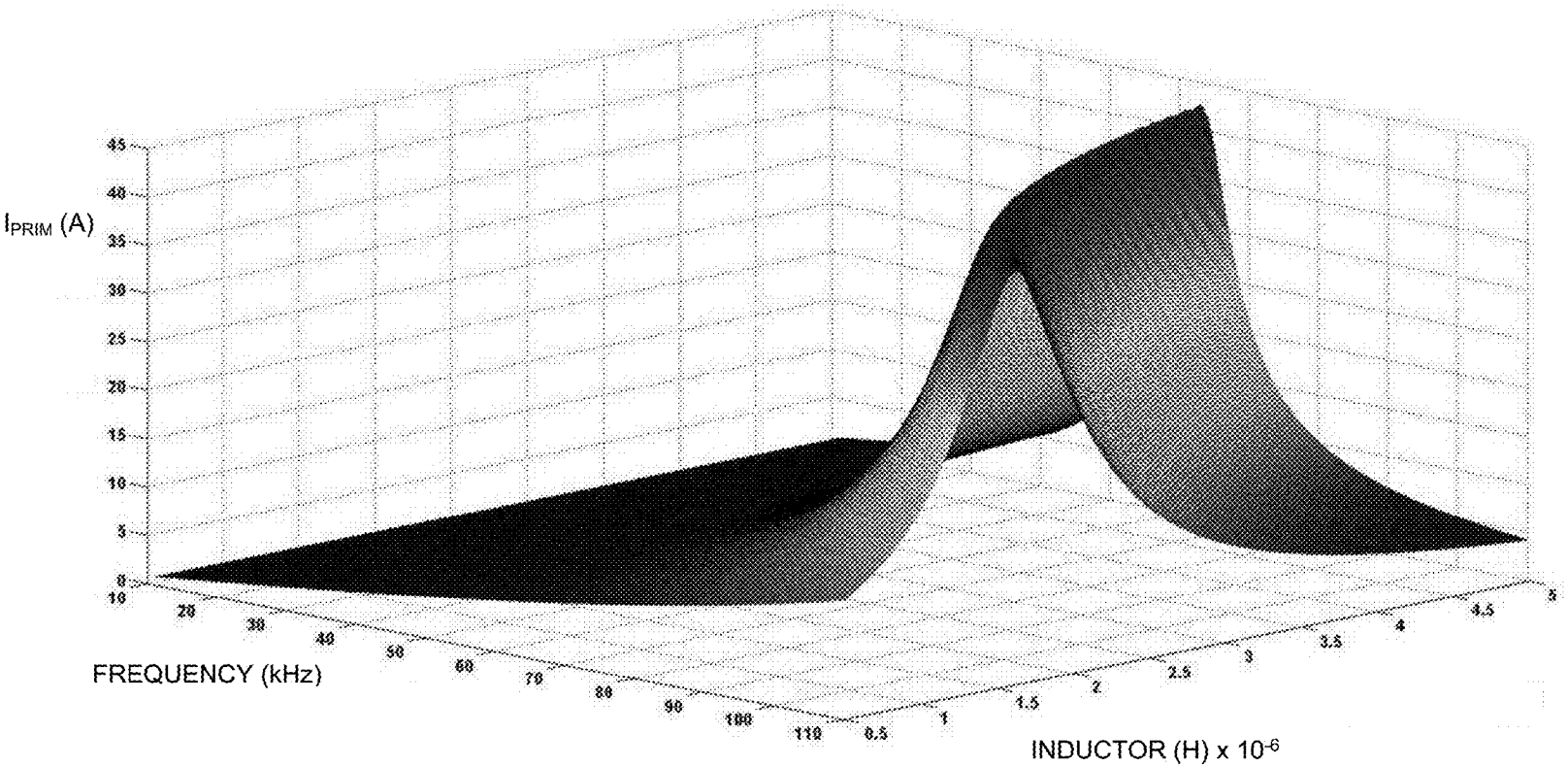
Figure 3C:
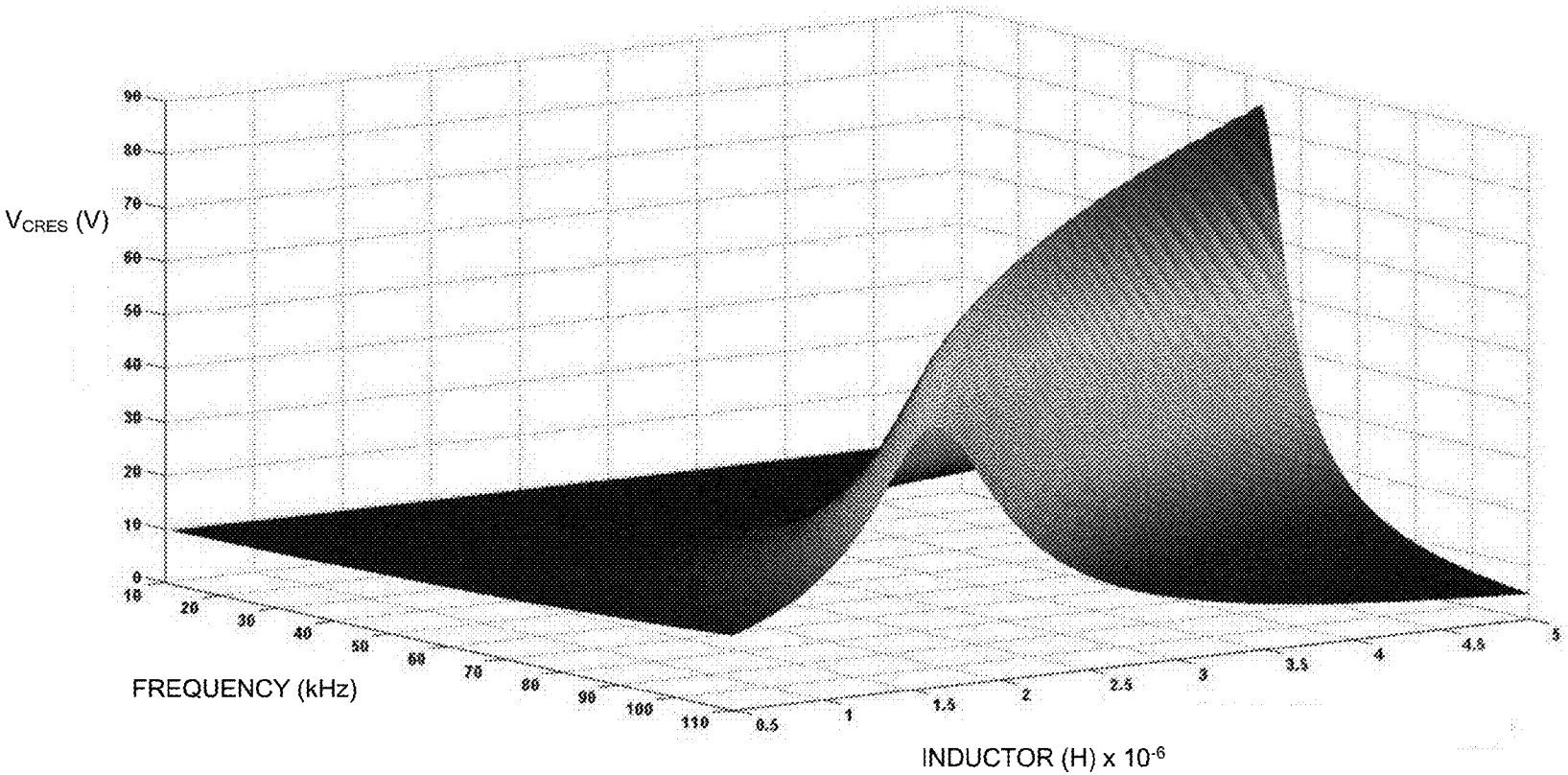

FIGS. 3A-3C are 3-dimensional (3D) graphs illustrating simulation results of the same implementation of the circuit 100 of FIG. 1 used to produce the simulation results illustrated in FIGS. 2A-2C, where the simulation results of FIGS. 3A-3C illustrate operation of the circuit 100 after arcing of the spark plug 125, e.g., during power delivery mode. Accordingly the simulation results of FIGS. 3A-3C are based on an implementation of the circuit 100 of FIG. 1 with the same circuit elements discussed above with respect to FIGS. 2A-2C. However, the simulation results of FIGS. 3A-3C show operation of the simulated circuit in power delivery mode after arcing of the spark plug. Accordingly, for the simulation results shown in FIGS. 3A-3C, the spark gap (load) is simulated as a 20 pF capacitor in parallel with a 5 kohm resistor (i.e., to simulate the spark plug after arcing or spark initiation).

As with the simulation results of FIGS. 2A-2C, the simulation results of FIGS. 3A-3C are shown across a range of $L_M$ values and a range of frequencies used to drive the half-bridge circuit, with FIG. 3A showing resulting voltages across the secondary winding of the HF ignition coil 105, FIG. 3B showing resulting currents through the primary winding of the HF ignition coil 105, and FIG. 3C showing resulting voltages across the resonant capacitor 160.

As shown in FIG. 3A, the circuit 100 is capable of generating approximately 1.5 kV across the secondary winding of the HF coil 105 in power delivery mode, which is nearly constant at higher resonant frequencies. FIG. 3B illustrates $I_{prim}$ is also nearly constant at higher resonant frequencies. FIG. 3C illustrates that $Vc_{res}$ increases with coil inductance. However, this increase may not affect operation or reliability of the circuit 100 due to $Vc_{res}$ being below 80 V.

Figure 4A:
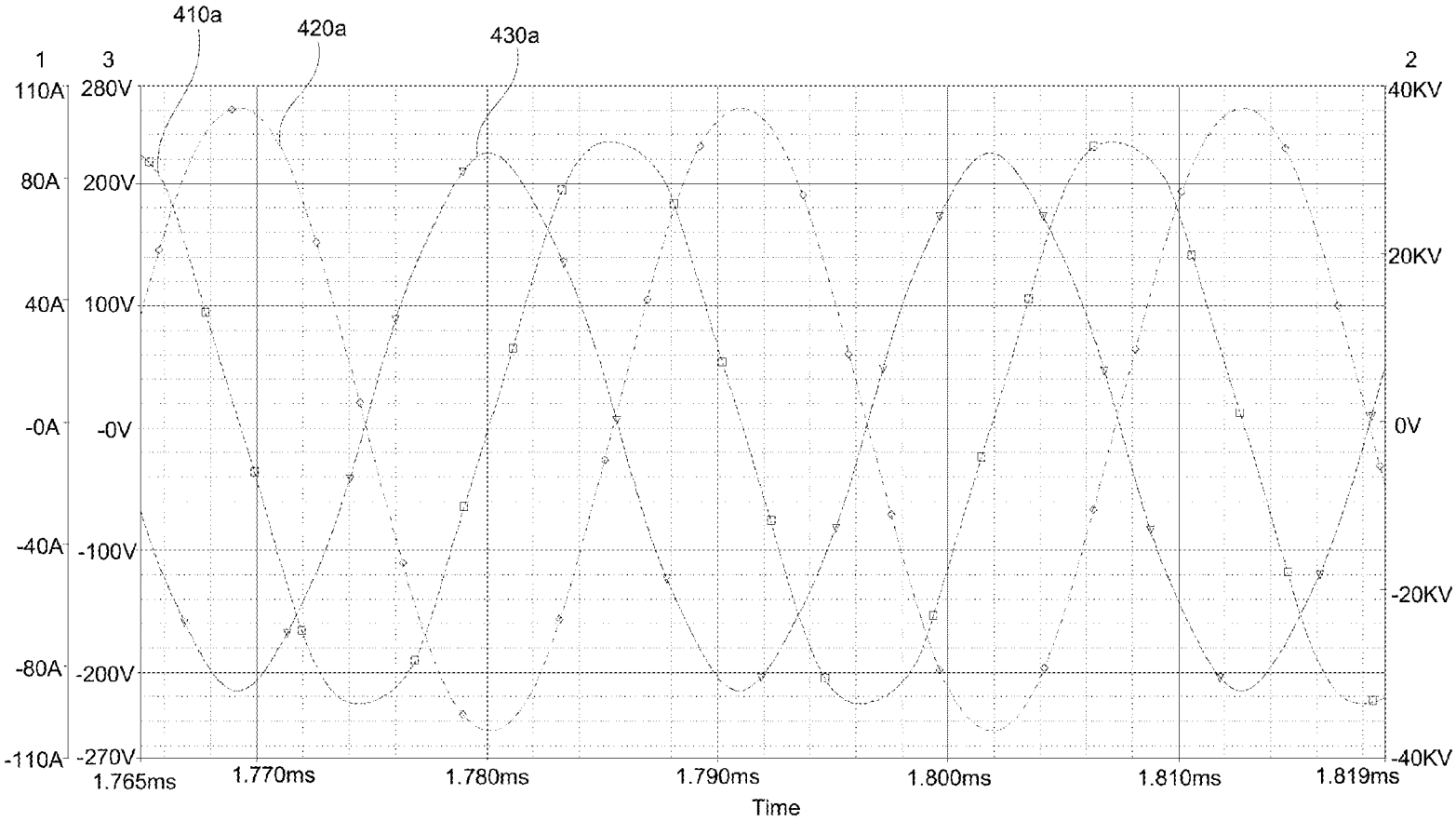
FIGS. 4A and 4B are time domain diagrams illustrating circuit simulation results of signal traces for an implementation of the circuit of FIG. 1.
Figure 4B:
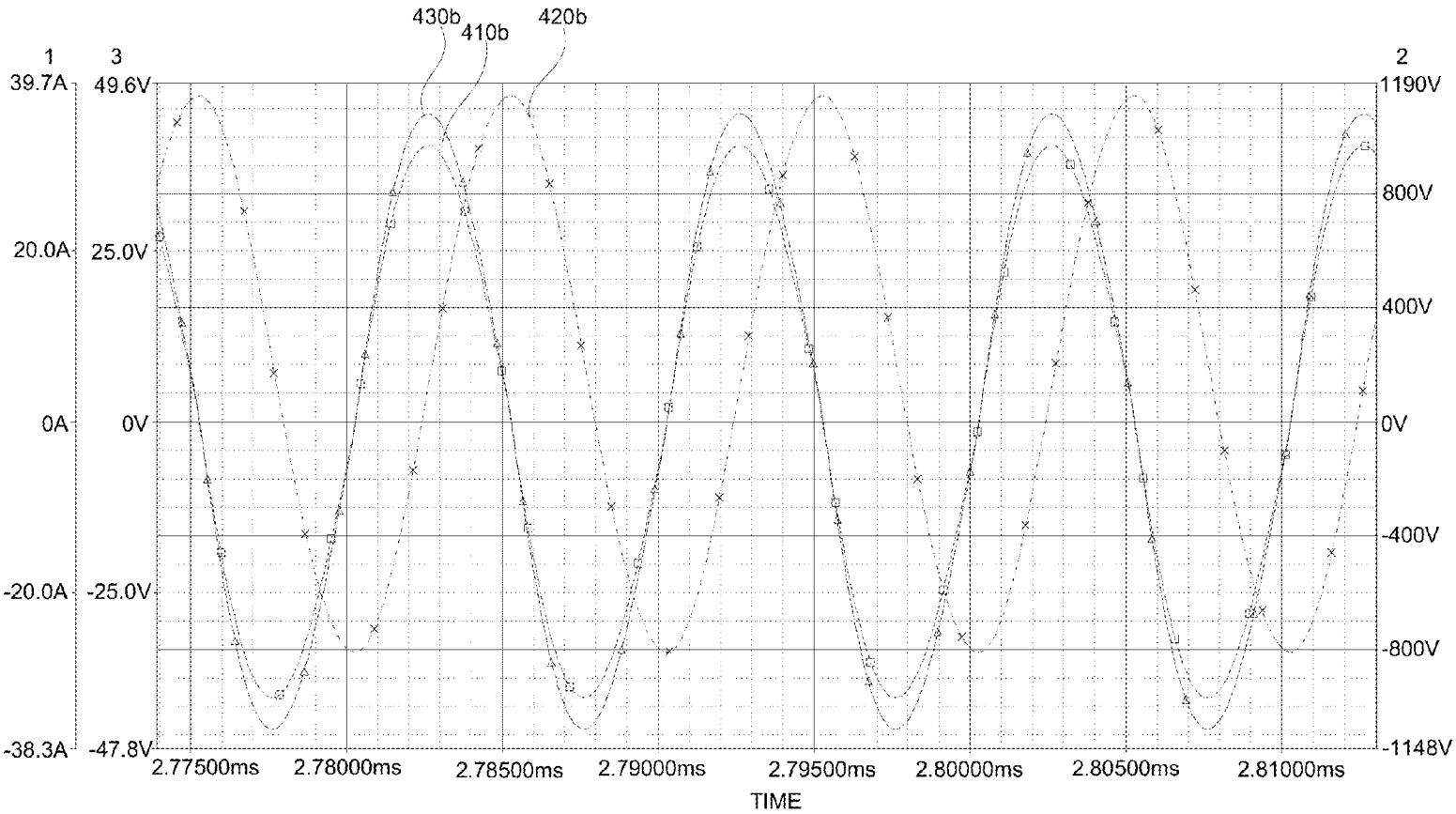

FIGS. 4A and 4B are graphs illustrating voltage and current signal traces of the implementation of the ignition circuit 100 of FIG. 1 discussed above with respect to FIGS. 1-3C. For instance, FIG. 4A illustrates signal traces of the circuit 100 prior to arcing of the spark plug 125 (e.g., with the gap of the spark plug 125 being simulated as a 20 pf capacitor in parallel with a 5 Mohm resistor, as in FIGS. 2A-2C), or during the high-voltage generation mode of the ignition circuit 100, where the MOSFETs 110 and 115 are driven with complimentary signals (such as the complementary signals illustrated in FIG. 1) at 45.92 kHz. In FIGS. 4A and 4B, signal traces 410*a* (FIG. 4A) and 410*b* (FIG. 4B) illustrate current in the primary winding of the HF ignition coil 105 (corresponding with Y-axis 1 in both FIGS. 4A and 4B), signal traces 420*a* (FIG. 4A) and 420*b* (FIG. 4B) illustrate a voltage across the resonant capacitor 160 (corresponding with Y-axis 2 in both FIGS. 4A and 4B), and signal traces 430*a* (FIG. 4A) and 430*b* (FIG. 4B) illustrate voltage across the secondary winding of the HF ignition coil 105 (corresponding with Y-axis 3 in both FIGS. 4A and 4B).

As shown in FIG. 4A by the signal trace 420*a* (corresponding with Y-axis 2), a voltage of approximately 37.5 kV can be generated across the secondary winding of the coil 105, which provides the arcing voltage that initiates spark in the spark plug 125. It will be appreciated that, during operation, arcing can occur below the peak voltage shown in FIG. 4A, and the traces 410*a*, 410*b* and 410*c* shown in FIG. 4A are given for purposes of illustration. The specific arcing voltage will depend on the particular implementation.

As indicated above, FIG. 4B illustrates the signal traces 410*b*, 420*b* and 430*c* for the circuit 100 of FIG. 1 during the energy delivery mode (power delivery for fuel mix burning mode, combustion mode, etc.). In FIG. 4B, the MOSFETs 110 and 115 of the circuit 100 can be driven (at their gate terminals) with complementary signal that are of a higher frequency, e.g., 100 kHz, than the frequency, e.g., 45.92 kHz, at which the complementary signals are driven during the high voltage generation mode of FIG. 4A. In FIG. 4B, the gap of the spark plug 125 is simulated as a 20 pf capacitor in parallel with a 5 kohm resistor, which simulates the reduced impedance of the spark gap after firing the spark plug. As shown in FIG. 4B by the signal trace 420*b* and Y-axis 2, during the energy delivery mode, the voltage across the secondary winding of the coil 105 drops to approximately 1200 V. As also shown in FIG. 4B, the frequency of the signals driving the MOSFETs 110 and 115 can be aligned with (e.g., to be approximately equal with) a resonant frequency of the resonant circuit formed by the leakage inductance L of the coil 105 and the resonant capacitor 160, such as illustrated by the alignment of the primary winding current trace 410*a* and the resonant capacitor voltage trace 410*b*.

FIG. 5 is a graph that illustrates voltage and current traces during shutdown (soft shutdown) of an implementation of the ignition circuit 100 of FIG. 1. Accordingly, for purposes of illustration, FIG. 5 is described with further reference to the circuit 100 FIG. 1. In FIG. 5, signal trace 510 illustrates a voltage across the secondary winding of the HF ignition coil 105, signal trace 520 illustrates a current through the primary winding of the coil 105, signal trace 530 illustrates a voltage across the resonant capacitor 160, and signal trace 540 illustrates a high-side drive signal (e.g., a signal applied to a gate terminal of the MOSFET 110 in the circuit of FIG. 1). In an implementation of the ignition circuit 100 of FIG. 1 that is associated with the signals during the soft shutdown period illustrated in FIG. 5, a gap of the spark plug 125 is simulated as a 10 Mohm resistance in parallel with a 20 pf capacitor, which simulates an open secondary condition (shown as time period OS in FIG. 5) of the HF coil 105, e.g., where no spark is present. As can be seen from the signal traces in FIG. 5, there is no high voltage spike generation in the HF coil 105 associated with the soft shutdown period and, therefore, little to no electrical stress is placed on the MOSFETs 110 and 115. In comparison, in current ignition circuits, high voltage spikes on an ignition coil's primary winding are clamped by an ignition IGBT under an open secondary condition, which can result in significant energy dissipation in, and electrical stress on the ignition IGBT.

As illustrated in FIG. 5, soft shutdown of the ignition circuit 110 occurs during the time period OS, in response to the high-side drive signal (signal trace 540) being held at a logic low level, which turns off the MOSFET 110 in the circuit 100 of FIG. 1, turning off or disabling the resonant circuit. As shown in FIG. 5, once the MOSFET 110 is turned off (which could also include turning off the MOSFET 115), the signal traces shown in FIG. 5 (the secondary winding voltage of signal trace 510, the primary winding current of signal trace 520 and the voltage on the resonant capacitor of signal trace 530) decay towards zero. This signal decay (soft shutdown) reduces electrical stress on the components of the ignition circuit of FIG. 1 as compared to the electrical stress circuit components of current implementations, which are subjected when a voltage spike is applied across an ignition IGBT (e.g., collector to emitter) when inducing a spark in a spark plug.

Figure 6:
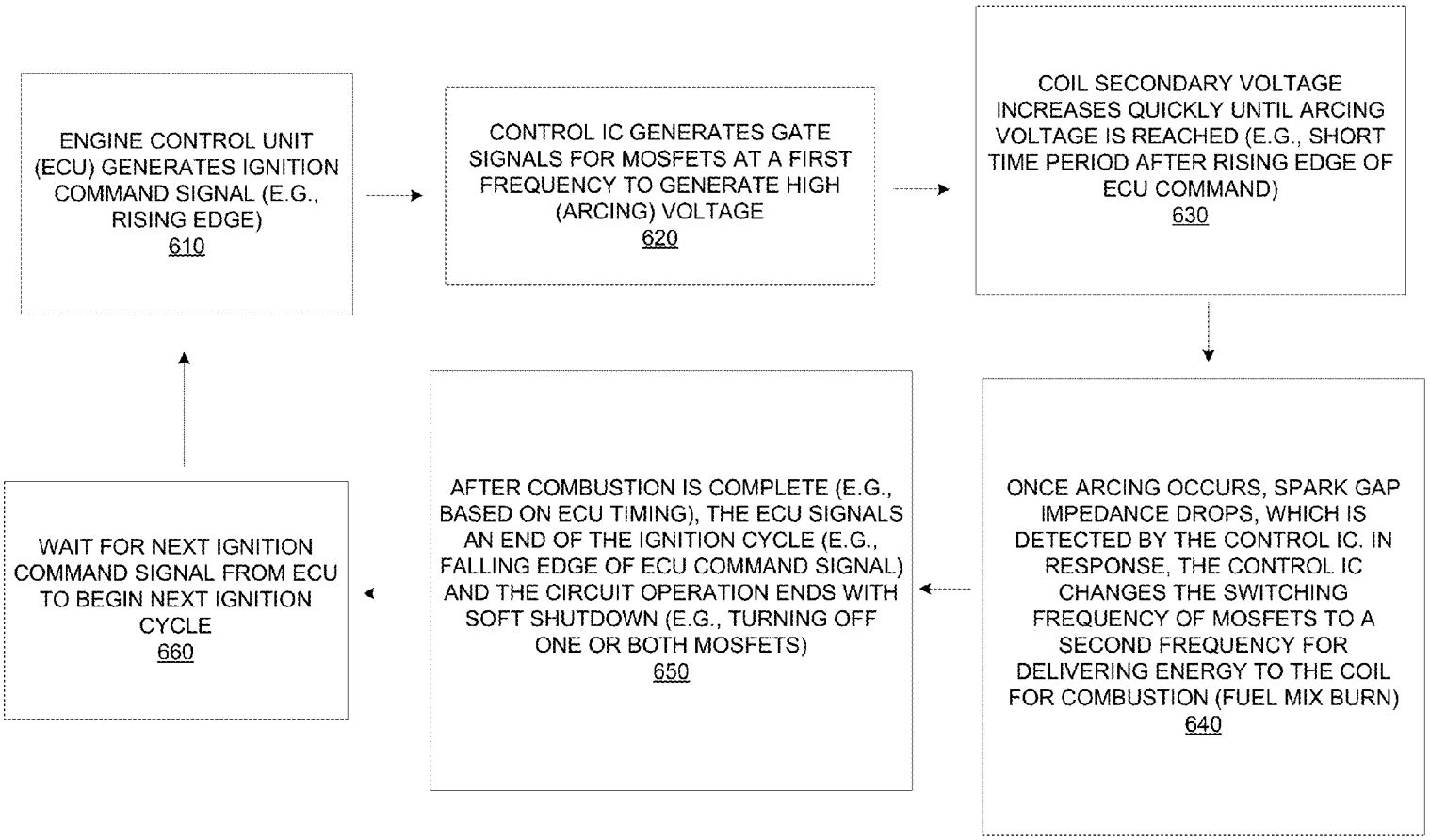
FIG. 6 is a flowchart illustrating a recurring ignition sequence that can be implemented by the circuit of FIG. 1.

FIG. 6 is a flowchart illustrating a recurring ignition sequence that can be implemented by the circuit 100 of FIG. 1. Accordingly, for purposes of illustration, the sequence of FIG. 6 will be described with further reference to FIG. 1. The sequence illustrated in FIG. 6 is an ignition sequence for a single cylinder of a given engine and can be implemented, respectively, for each cylinder of the engine. Such a sequence can also be implemented for other ignition circuits, such as the ignition circuits illustrated in FIGS. 7A-7F.

In the ignition sequence of FIG. 6, at block 610, an Engine Control Unit (ECU) can generate an ignition command signal (e.g., change the ignition command signal from logic low to logic high or logic high to logic low) and the ignition command signal can be received at the terminal 130 of the control IC 120 of the circuit 100. At block 620, the control IC 120, in response to the change in (logic) state of the ignition control signal (e.g., a rising edge or falling edge of the command signal), can generate complementary gate drive signals for the MOSFETs 110 and 115 of FIG. 1 at a first frequency to generate a high voltage in the HF coil 105 that is sufficient to arc (fire) the spark plug 125. As discussed above, this period can be referred to as the high-voltage generation or high-voltage accumulation mode. Depending on the particular implementation, the arcing voltage of the spark plug 125 can be in a range of, e.g., 15 kV-40 kV.

At block 630, during the high-voltage generation mode, the voltage on the secondary winding quickly increases as a result of the voltage induced across the primary winding of the coil 105 by the multi-resonant circuit on the primary side of the coil 105. Once the arcing (spark initiation) voltage is reached, at block 640, the impedance of the spark gap drops (e.g. from Mohms to kohms), such as in the examples discussed above. This change in spark gap impedance (e.g., as a result of the firing of the spark plug 125) can be detected by the control IC 120. At block 640, in response to detecting the change in spark gap impedance, the control IC 120 can change the switching frequency of the complementary signals provided to the MOSFETs 110 and 115 to a frequency for delivering energy to the spark plug 125 for combusting (burning) the fuel mixture in the associated engine cylinder (e.g., which can be higher or lower than the frequency used during the high voltage generation mode).

After combustion is complete, which can be based on timing in the ECU, the ignition command signal, at block 650, can change state again (e.g., from logic high to logic low or logic low to logic high) and, in response, the control IC 120 will stop delivering complementary signals to the MOSFETs 110 and 115, turning off one or both MOSFETs. In response to the control IC 120 turning off one or both of the MOSFETs 110 and 115, soft shutdown of the ignition circuit occurs, such as illustrated in FIG. 5. In the ignition cycle of FIG. 6, after soft shutdown at block 650, the ignition circuit 100, at block 660, waits for the next change in state of the ignition command signal to begin the next ignition cycle for the associated cylinder at block 610. In certain implementations, timing of delivery of the resonant signals at the first frequency and the second frequency, and turning off the MOSFETs 110 and/or 115 can be controlled by the control circuit 120 in response to a single edge (e.g., rising edge or falling edge) of the command signal.

FIGS. 7A-7F are schematic block diagrams of implementation of ignition circuits, which are variations of each other and of the ignition circuit 100 illustrated in FIG. 1. The following discussion of FIGS. 7A-7F notes differences in each of these implementations, as compared to the circuit of FIG. 1 and/or as compared to each other. For purposes of illustration, like elements of the circuits of FIGS. 7A-7F with those of the circuit 100 of FIG. 1 are labeled with like reference numbers. Also, for purposes of brevity, each of these elements is not described again in detail with respect to FIGS. 7A-7F. Those elements in FIGS. 7A-7F that are different from the elements of the circuit 100 of FIG. 1 are designated with 700 series numbers, and those differences are discussed below.

Figure 7A:
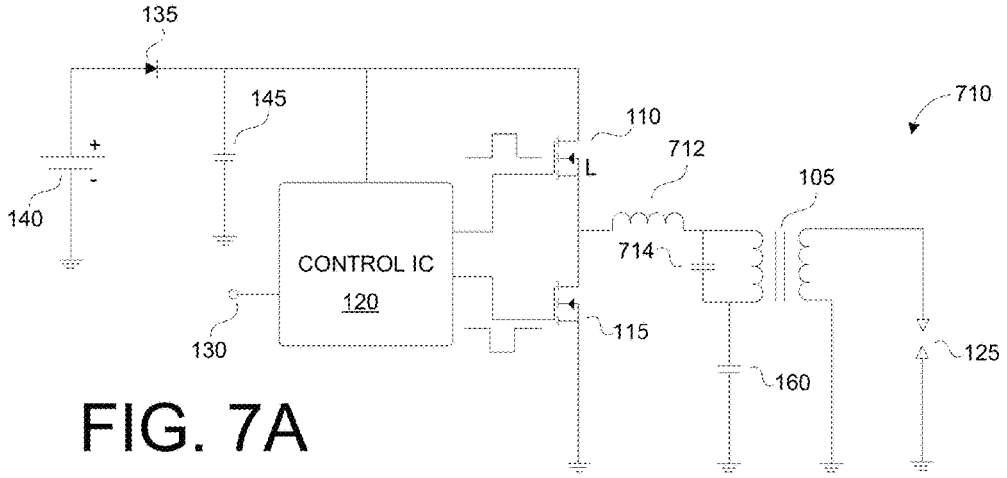
FIGS. 7A-7F are schematics/block diagrams of ignition circuits, according to implementations.

FIG. 7A illustrates an ignition circuit 710 that has a resonant circuit that includes an inductor 712 that is external to the HF ignition coil 105 and two resonant capacitors 160 (as in the circuit 100) and 714, the resonant capacitor 714 is in parallel with the primary winding of the coil 105, while the resonant capacitor 160 is in series with the primary winding of the coil 105 (as in the circuit 100 of FIG. 1). In the ignition circuit 710, the resonant circuit includes the inductor 712, and the two capacitors 160 and 714. Further in the circuit 710, the MOSFETs 110 and 115 operate in a complimentary manner, as described herein, to provide an alternating-current (AC) voltage signal (which can also has a direct-current (DC) voltage component) to the resonant circuit. A voltage across the capacitor 714 determines (establishes, etc.) a voltage that is provided to the spark plug 125 for spark initiation (e.g., high-voltage accumulation) and an amount of energy that is provided to the spark plug 125 for combustion (e.g., power delivery). Energy to be delivered to spark plug 125 can also be controlled by modifying a switching frequency of the MOSFETs 110 and 115.

Figure 7B:
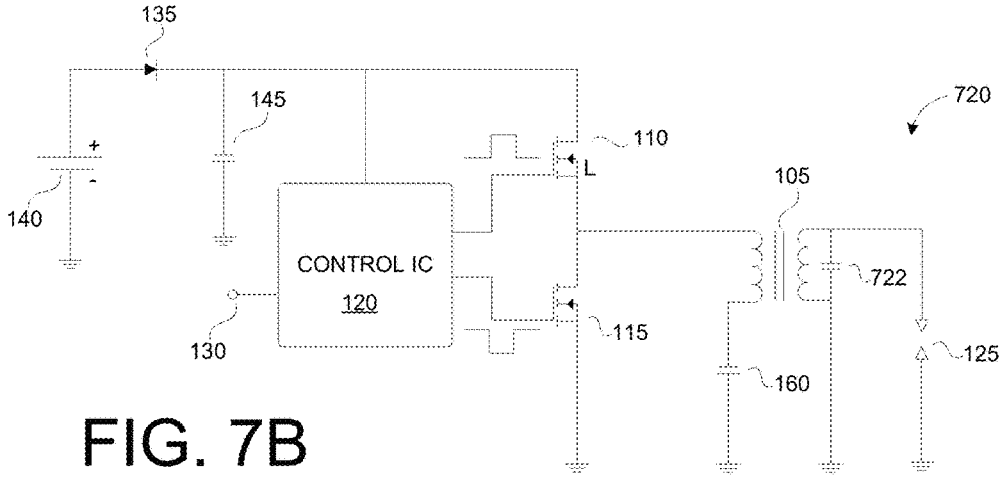

FIG. 7B illustrates an ignition circuit 720 that has a resonant circuit that includes the leakage inductance L of the primary winding of the HF ignition coil 105 (such as described above with respect to FIG. 1), the resonant capacitor 160 (on a primary side of the coil 105) and a second resonant capacitor 722 on a secondary side of the coil 105, where the resonant capacitor 722 is coupled in parallel with the secondary winding of the coil 105. In the circuit 720, the resonant circuit includes the leakage inductance L of the ignition coil 105 and the resonant capacitors 160 and 722, while the MOSFETs 110 and 115 operate in a complimentary manner (such as described herein) to provide an AC voltage (which can include a DC voltage component) to the resonant circuit. The voltage of resonant capacitor 722 on the secondary side of ignition coil determines (establishes, etc.) a voltage that is provided to the spark plug 125 for spark initiation (e.g., high-voltage accumulation) and an amount of energy that is provided to the spark plug 125 for combustion (e.g., power delivery). The capacitor 722 can be implemented using a high-voltage capacitor or a plurality of capacitors coupled in series to achieve a sufficient voltage rating (storage capacity). Energy to be delivered to spark plug 125 can also be controlled by modifying a switching frequency of the MOSFETs 110 and 115.

Figure 7C:
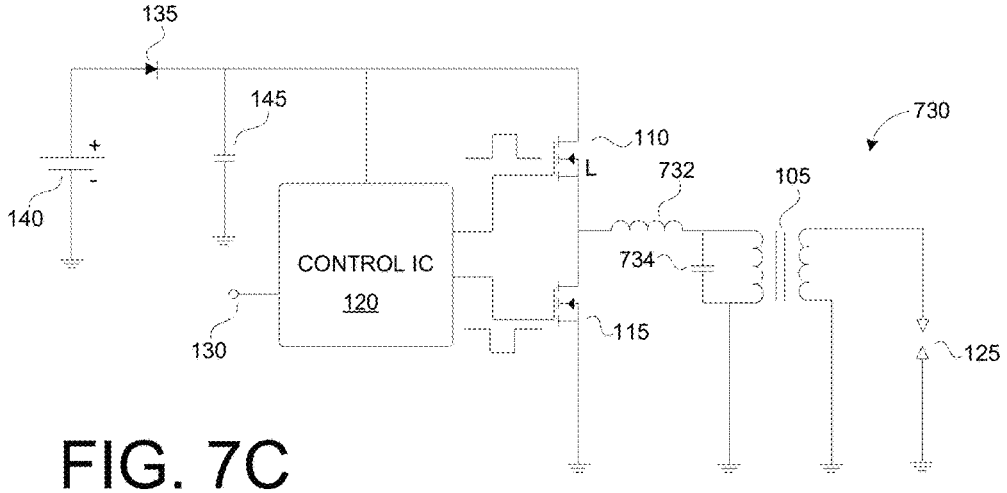

FIG. 7C illustrates an ignition circuit 730 that has a resonant circuit that includes an inductor 732 that is external to the HF ignition coil 105 and a resonant capacitor 734 that is coupled in parallel with a primary winding of the coil 105. The resonant capacitor 160 of the circuit 100 is omitted in this implementation. In the circuit 730, the resonant circuit includes the inductor 732, the resonant capacitor 734, and the primary winding of ignition coil 105, while the MOSFETs 110 and 115 operate in a complimentary manner (as described herein) to provide an AC voltage (which can include a DC voltage component) to the resonant circuit. The energy to be delivered to spark plug 125 (for spark initiation and combustion) can also be controlled by modifying a switching frequency of the MOSFETs 110 and 115.

Figure 7D:
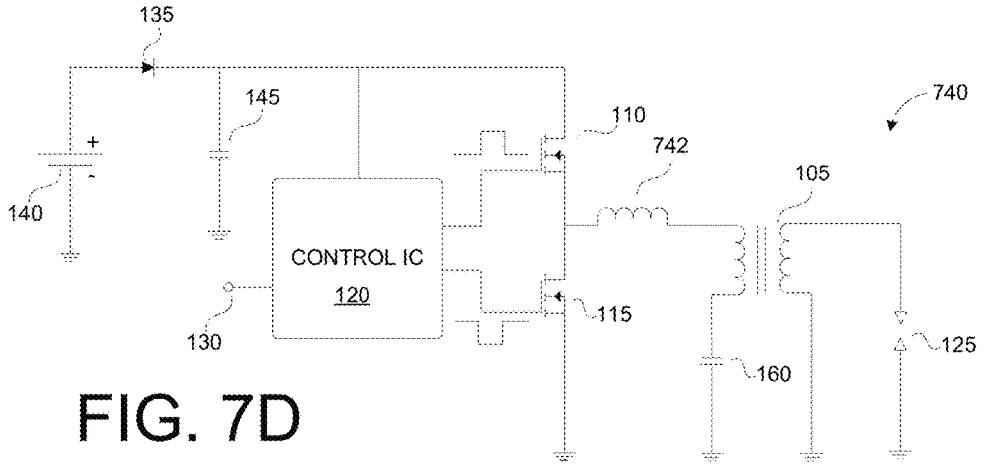

FIG. 7D illustrates an ignition circuit 740 that has a resonant circuit that includes an inductor 742 that is external to the HF ignition coil 105, the resonant capacitor 160 coupled in series with the primary winding (such as in the circuit of FIG. 1) and the inductance (e.g., leakage inductance L and magnetic inductance $L_M$) of the primary winding of the coil 105. Operation of the circuit 740 is similar to that of the circuit 100 of FIG. 1, while the external inductor 742 plus the leakage inductance L of the coil 105 becomes a component of the resonant circuit. The circuit 740 can be implemented in applications where the leakage inductance L of the ignition coil 105 is insufficient to resonate with the resonant capacitor at desired operating conditions.

Figure 7E:
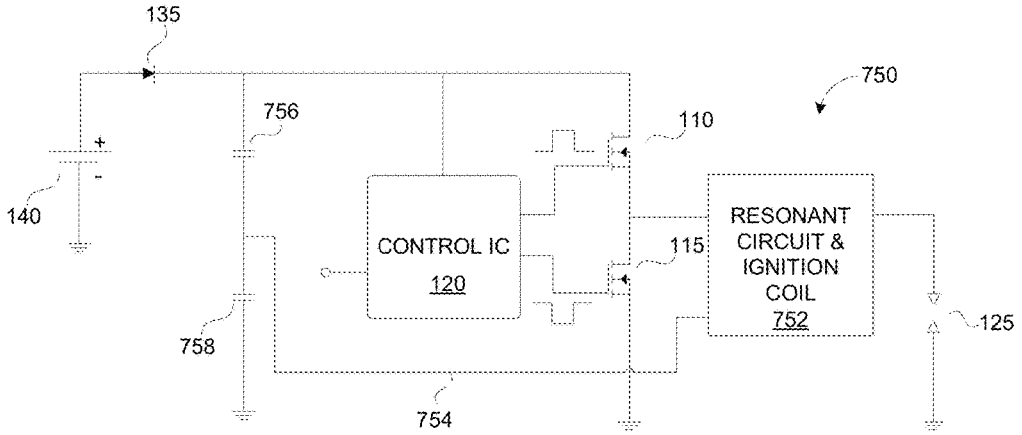

FIG. 7E illustrates an ignition circuit 750 that includes a resonant circuit and ignition coil (resonant circuit) 752. The resonant circuit 752 can be implemented, for example, using any of the resonant circuits shown in FIGS. 1, 7A-7D. In the circuit 750 of FIG. 7E, rather than using the supply cap 145, an input voltage (e.g., a DC voltage from the vehicle battery 140) is split by two capacitors 756 and 758 (which can be referred to as DC capacitors). Additionally in the circuit of FIG. 7E, a power return line 754 from the resonant circuit 752 is coupled to a mid-point node between the two DC capacitors 756 and 758. In this implementation, a voltage supplied to the resonant circuit 752 has no DC component, but is an AC voltage that is a square wave with a plus/minus magnitude of one-half a voltage of the battery 140.

Figure 7F:
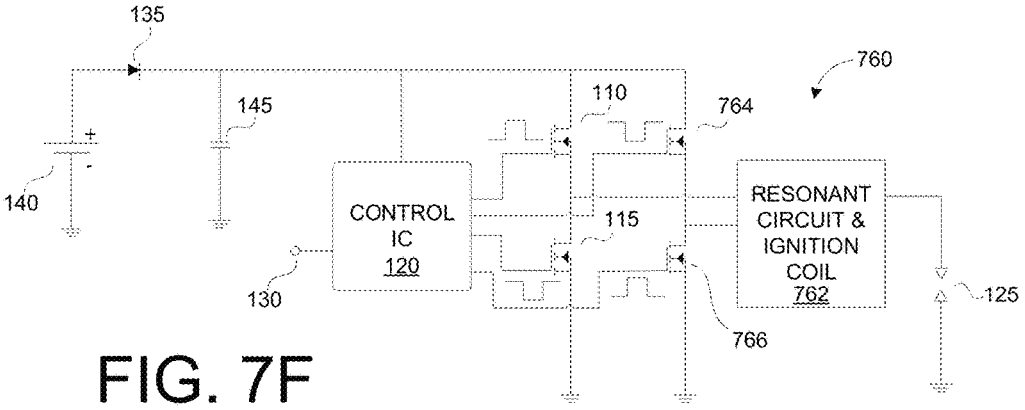

FIG. 7F, illustrates an ignition circuit 760 that includes a resonant circuit and ignition coil (resonant circuit) 762. The resonant circuit 762 can be implemented, for example, using any of the resonant circuits shown in FIGS. 1, 7A-7D. Further, in the circuit 760 of FIG. 7F, a full bridge topology that includes MOSFETs 764 and 766 in addition to the MOSFETS 110 and 115 is used. This full-bridge topology can be used to convert a DC voltage to an AC voltage, where the AC voltage supplies power to the resonant circuit 762 (including an HF ignition coil of the resonant circuit 762). In this implementation, as with the circuit 750, a voltage supplied to the resonant circuit 762 has no DC voltage component, but is an AC voltage that is a square wave with a plus/minus magnitude of a voltage of the battery 140. Implementations of the circuit 760 can be used in applications where very low battery voltage operation (e.g., 4-6 V) and very high energy delivery is required, which can occur, for example, when starting a vehicle including the ignition circuit 100 at cold ambient temperatures.

In a first example, a method can include: receiving, from an engine control unit at an ignition circuit, a command signal; in response to the command signal, operating a resonant circuit of the ignition circuit at a first frequency to generate a voltage in an ignition coil, the generated voltage in the ignition coil initiating a spark in a spark plug of a cylinder of an engine, the spark plug being coupled with the ignition coil; after the spark is initiated in the spark plug, operating the resonant circuit at a second frequency to provide energy to the ignition coil and the spark plug for combustion of a fuel mixture in the cylinder of the engine; and, after the combustion of the fuel mixture, disabling the resonant circuit.

In a second example based on the first example, the operating the resonant circuit of the ignition circuit at the first frequency can be in response to a first edge of the command signal. The disabling the resonant circuit can be in response to a second edge of the command signal, the second edge being opposite the first edge.

In a third example based on any one of the first or second examples, the first frequency is greater than the second frequency.

In a fourth example, based on any one of the first through third examples, the operating the resonant circuit at the first frequency includes: providing complementary signals of the first frequency to a half-bridge circuit, the half-bridge circuit being coupled with the resonant circuit, the half-bridge circuit providing an alternating current signal of the first frequency to the resonant circuit.

In a fifth example, based on any one of the first through fourth examples, the operating the resonant circuit at the second frequency can include providing complementary signals of the second frequency to a half-bridge circuit, the half-bridge circuit being coupled with the resonant circuit, the half-bridge circuit providing an alternating current signal of the second frequency to the resonant circuit.

In a sixth example, based on any one of the first through third examples, the operating the resonant circuit at the first frequency can include providing complementary signals of the first frequency to a full-bridge circuit, the full-bridge circuit being coupled with the resonant circuit. The full-bridge circuit, in response to the complementary signals of the first frequency, can provide an alternating-current (AC) signal of the first frequency to the resonant circuit. The operating the resonant circuit at the second frequency can include providing complementary signals of the second frequency to the full-bridge circuit. The full-bridge circuit, in response to the complementary signals of the second frequency, can provide an AC signal of the second frequency to the resonant circuit.

In a seventh example, based on the sixth example, the AC signal may not include a direct-current (DC) voltage component.

In an eighth example, based on any one of the first through third examples, the operating the resonant circuit at the first frequency can include providing an alternating-current (AC) signal of the first frequency to an inductive-capacitive (LC) resonant circuit that includes a primary winding of the ignition coil; and the operating the resonant circuit at the second frequency can include providing an AC signal of the second frequency to the LC resonant circuit.

In a ninth example, based on the eighth example, the AC signal of the first frequency and the AC signal of the second frequency can include a direct current (DC) voltage component.

In a tenth example, an ignition circuit can include a control circuit that is configured to be coupled with an engine control unit (ECU) to receive a command signal from the ECU; and a driving circuit coupled with the control circuit, the driving circuit being configured to be coupled with a resonant circuit that includes a primary winding of an ignition coil. The control circuit and the driving circuit can be configured, in response to the command signal, to: drive the resonant circuit at a first frequency to generate a voltage in the ignition coil to initiate a spark in a spark plug coupled with the ignition coil; and in response to the spark being initiated in the spark plug, drive the resonant circuit at a second frequency to maintain the spark in the spark plug for combustion of a fuel mixture. The control circuit can be further configured, after the combustion of the fuel mixture, to disable the driving circuit.

In an eleventh example based on the tenth example, the resonant circuit can include at least one resonant capacitor In a twelfth example based on the eleventh example, a resonant capacitor of the at least one resonant capacitor can be coupled in series with a primary winding of the ignition coil.

In a thirteenth example based on any one of the eleventh or twelfth examples, a resonant capacitor of the at least one resonant capacitor can be coupled in parallel with a primary winding of the ignition coil.

In a fourteenth example based on any one of the eleventh or twelfth examples, a resonant capacitor of the at least one resonant capacitor can be coupled in parallel with a secondary winding of the ignition coil.

In a fifteenth example based on any one of the tenth through fourteenth examples, the resonant circuit can include an inductor coupled between the driving circuit and a primary winding of the ignition coil.

In a sixteenth example based on any one of the tenth through fifteenth examples, the driving circuit can include one of a half-bridge circuit or a full-bridge circuit.

In a seventeenth example based any one of the tenth through sixteenth examples, the control circuit can be configured to provide complementary signals of the first frequency or the second frequency to the driving circuit; and the driving circuit, in response to the complementary signals of the first frequency or the second frequency, can be configured to provide a respective alternating-current signal of the first frequency or the second frequency to the resonant circuit.

In an eighteenth example, an ignition circuit can include a control circuit that is coupled with an engine control unit (ECU) to receive a command signal from the ECU; a driving circuit coupled with the control circuit; and a resonant circuit coupled with the driving circuit, the resonant circuit including a primary winding of an ignition coil. The control circuit and the driving circuit can be configured, in response to a first edge of the command signal, to: drive the resonant circuit at a first frequency to generate a voltage in the ignition coil to initiate a spark in a spark plug coupled with the ignition coil; and in response to the spark being initiated in the spark plug, drive the resonant circuit at a second frequency to maintain the spark in the spark plug. The control circuit can be configured, in response to a second edge of the command signal that is opposite the first edge, to disable the driving circuit.

In a nineteenth example based on the eighteenth example, the driving circuit can include one of a half-bridge circuit and a full-bridge circuit.

In a twentieth example based on any one of the eighteenth and nineteenth examples, the resonant circuit can include at least one resonant capacitor coupled with the ignition coil.

The various apparatus and techniques described herein may be implemented using various semiconductor processing and/or packaging techniques. Some embodiments may be implemented using various types of semiconductor processing techniques associated with semiconductor substrates including, but not limited to, for example, Silicon (Si), Gallium Arsenide (GaAs), Silicon Carbide (SiC), and/or so forth.

While certain features of the described implementations have been illustrated as described herein, many modifications, substitutions, changes and equivalents will now occur to those skilled in the art. It is, therefore, to be understood that the claims, when appended, are intended to cover all such modifications and changes as fall within the scope of the embodiments. It should be understood that they have been presented by way of example only, not limitation, and various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described.

What is claimed is:

1. A method comprising:

receiving, from an engine control unit at an ignition circuit, a command signal;

in response to the command signal, operating a resonant circuit of the ignition circuit at a first frequency to generate a voltage in an ignition coil, the generated voltage in the ignition coil initiating a spark in a spark plug of a cylinder of an engine, the spark plug being coupled with the ignition coil;

after the spark is initiated in the spark plug, operating the resonant circuit at a second frequency to provide energy to the ignition coil and the spark plug for combustion of a fuel mixture in the cylinder of the engine; and after the combustion of the fuel mixture, disabling the resonant circuit.

2. The method of claim 1, wherein:

the operating the resonant circuit of the ignition circuit at the first frequency is in response to a first edge of the command signal; and the disabling the resonant circuit is in response to a second edge of the command signal, the second edge being opposite the first edge.

3. The method of claim 1, wherein the first frequency is greater than the second frequency.

4. The method of claim 1, wherein the operating the resonant circuit at the first frequency includes:

providing complementary signals of the first frequency to a half-bridge circuit, the half-bridge circuit being coupled with the resonant circuit, the half-bridge circuit providing an alternating current signal of the first frequency to the resonant circuit.

5. The method of claim 1, wherein operating the resonant circuit at the second frequency includes:

providing complementary signals of the second frequency to a half-bridge circuit, the half-bridge circuit being coupled with the resonant circuit, the half-bridge circuit providing an alternating current signal of the second frequency to the resonant circuit.

6. The method of claim 1, wherein:

the operating the resonant circuit at the first frequency includes providing complementary signals of the first frequency to a full-bridge circuit, the full-bridge circuit being coupled with the resonant circuit, the full-bridge circuit, in response to the complementary signals of the first frequency, providing an alternating-current (AC) signal of the first frequency to the resonant circuit; and the operating the resonant circuit at the second frequency includes providing complementary signals of the second frequency to the full-bridge circuit, the full-bridge circuit, in response to the complementary signals of the second frequency, providing an AC signal of the second frequency to the resonant circuit.

7. The method of claim 6, wherein the AC signal does not include a direct-current (DC) voltage component.

8. The method of claim 1, wherein:

the operating the resonant circuit at the first frequency includes providing an alternating-current (AC) signal of the first frequency to an inductive-capacitive (LC) resonant circuit that includes a primary winding of the ignition coil; and the operating the resonant circuit at the second frequency includes providing an AC signal of the second frequency to the LC resonant circuit.

9. The method of claim 8, wherein the AC signal of the first frequency and the AC signal of the second frequency each includes a direct current (DC) voltage component.

10. An ignition circuit comprising:

a control circuit that is configured to be coupled with an engine control unit (ECU) to receive a command signal from the ECU; and a driving circuit coupled with the control circuit, the driving circuit being configured to be coupled with a resonant circuit that includes a primary winding of an ignition coil, the control circuit and the driving circuit being configured, in response to the command signal, to:

drive the resonant circuit at a first frequency to generate a voltage in the ignition coil to initiate a spark in a spark plug coupled with the ignition coil; and in response to the spark being initiated in the spark plug, drive the resonant circuit at a second frequency to maintain the spark in the spark plug for combustion of a fuel mixture, and the control circuit being further configured, after the combustion of the fuel mixture, to disable the driving circuit.

11. The ignition circuit of claim 10, wherein the resonant circuit further includes at least one resonant capacitor.

12. The ignition circuit of claim 11, wherein a resonant capacitor of the at least one resonant capacitor is coupled in series with the primary winding of the ignition coil.

13. The ignition circuit of claim 11, wherein a resonant capacitor of the at least one resonant capacitor is coupled in parallel with the primary winding of the ignition coil.

14. The ignition circuit of claim 11, wherein a resonant capacitor of the at least one resonant capacitor is coupled in parallel with a secondary winding of the ignition coil.

15. The ignition circuit of claim 11, wherein the resonant circuit further includes an inductor coupled between the driving circuit and the primary winding of the ignition coil.

16. The ignition circuit of claim 10, wherein the driving circuit includes one of a half-bridge circuit or a full-bridge circuit.

17. The ignition circuit of claim 16, wherein:

the control circuit is configured to provide complementary signals of the first frequency or the second frequency to the driving circuit; and the driving circuit, in response to the complementary signals of the first frequency or the second frequency, is configured to provide a respective alternating-current signal of the first frequency or the second frequency to the resonant circuit.

18. An ignition circuit comprising:

a control circuit that is coupled with an engine control unit (ECU) to receive a command signal from the ECU;

a driving circuit coupled with the control circuit; and a resonant circuit coupled with the driving circuit, the resonant circuit including a primary winding of an ignition coil, the control circuit and the driving circuit being configured, in response to a first edge of the command signal, to:

drive the resonant circuit at a first frequency to generate a voltage in the ignition coil to initiate a spark in a spark plug coupled with the ignition coil; and in response to the spark being initiated in the spark plug, drive the resonant circuit at a second frequency to maintain the spark in the spark plug, and the control circuit being further configured, in response to a second edge of the command signal that is opposite the first edge, to disable the driving circuit.

19. The ignition circuit of claim 18, wherein the driving circuit includes one of a half-bridge circuit or a full-bridge circuit.

20. The ignition circuit of claim 18, wherein the resonant circuit further includes at least one resonant capacitor coupled with the ignition coil.

* * * * *